US005167539A

United States Patent [19]

Okamoto et al.

[11] Patent Number: 5,167,539

[45] Date of Patent: Dec. 1, 1992

[54] NOISE SUPPRESSING CONNECTOR

[75] Inventors: Hiroyuki Okamoto; Kunio Hoshino; Masakazu Umemura; Masami Katayama, all of Shizuoka, Japan

[73] Assignee: Yazaki Corporation, Japan

[21] Appl. No.: 757,781

[22] Filed: Sep. 11, 1991

[30] Foreign Application Priority Data

Sep. 20, 1990 [JP] Japan ..... 2-248757

[51] Int. Cl.[5] ..... H01R 13/66

[52] U.S. Cl. ..... 439/620; 333/185

[58] Field of Search ..... 439/620, 608; 333/181-185

[56] References Cited

U.S. PATENT DOCUMENTS 4,606,598 8/1986 Kowski et al. ..... 439/608
4,784,618 11/1988 Sakamoto et al. ..... 439/620
4,791,391 12/1988 Linnell et al. ..... 439/620
4,995,834 2/1991 Hasegawa ..... 439/620

FOREIGN PATENT DOCUMENTS 59-184478 10/1984 Japan .

*Primary Examiner*—Gary F. Paumen

*Attorney, Agent, or Firm*—Nikaido, Marmelstein, Murray & Oram

[57] ABSTRACT

The object of the present invention is to provide a noise suppressing connector adopting a noise filtering structure which is capable of reducing the manufacturing processes, eliminating the conventional problems (i.e., the occurrence of incomplete connections by soldering the destruction of the aluminum plate, and so on), and thereby improving the quality of the noise filtering structure itself. In order to attain the above object, the noise suppressing connector according to the present invention incorporates a metal casing having one or more terminal insertion holes in the bottom wall thereof and formed with a capacitor section around each of these insertion holes; a pin terminal inserted through the terminal insertion hole and electrically connected to the capacitor section using soldering; and an insulating housing incorporated into to the metal casing, wherein the capacitor section is directly connected to the metal casing. With such a construction, a conventionally adopted alumina plate is made unnecessary, thereby resulting in a reduction in mechanical parts and in the elimination of soldering connections in some parts thereof. Therefore, a reduction in the number of manufacturing processes required is also made possible.

4 Claims, 3 Drawing Sheets

PRIOR ART

NOISE SUPPRESSING CONNECTOR

BACKGROUND OF THE INVENTION

1. Field of the Invention

The present invention relates to a noise suppressing connector which adopt a noise filtering structure formed on a metal casing.

2. Description of the Prior Art

Conventionally, various noise suppressing connectors adopting a noise filtering structure have been invented by now, a case in point being the one disclosed in Japanese Patent application laid-open No. 59-184478 as shown in FIGS. 6 and 7, which respectively represent a longitudinal sectional view showing a noise preventing connector and a magnified sectional view thereof.

In FIG. 6, reference numeral 16 denotes a noise suppressing connector comprising an insulating housing 17, a metal casing 19 having a ground contact 18 and disposed at the end portion of the insulating housing 17, an alumina plate 20 having a capacitor C' and disposed in the middle portion of the metal casing 19, and a pin terminal 22 firmly inserted through a terminal insertion hole 21 formed in the alumina plate 20, whereby the pin terminal 22 is electrically conducted to the metal casing 19 by way of the capacitor C' formed on the alumina plate 20.

In FIG. 7, reference numeral 23 denotes a noise filtering structure in the above noise suppressing connector 16, wherein the noise filtering structure 23 comprises the above described capacitor C'. The capacitor C' itself comprises a ground leading layer 24 formed on the alumina plate 20, a plurality of dielectric layers 25 formed on the ground leading layer 24, a terminal electrode layer 26 formed on one of the plurality of dielectric layers 25 with one end portion thereof 26*a* extended up to the inner side of the above described terminal insertion hole 21, a plurality of insulating layers 27 formed on the terminal electrode layer 26, wherein the terminal electrode layer 26 is connected to the pin terminal 22 by means of a soldering 28, and the ground leading layer 24 is connected to the metal casing 19 also by means of a soldering 29. FIG. 8 is an illustration showing a block diagram of a circuit wherein the pin terminal 22 is grounded by way of the thus constructed capacitor C' formed on the alumina plate 22.

However, in a conventional structure constructed as above, since the alumina plate 20 has to be connected to the metal casing 19 by a soldering 29, many manufacturing processes are required, and incomplete connection therebetween is frequently observed due to a badly performed soldering or the like. Further, since the alumina plate 20 itself is not strong enough, it is likely to be broken when some impact is applied thereto.

SUMMARY OF THE INVENTION

The present invention has been made to eliminate such problems as described above, and it is an object of the present invention to provide a noise suppressing connector adopting a noise filtering structure which is capable of reducing the number of manufacturing processes required, eliminating the above-described problems such as the occurrence of the incomplete connection of the soldering or destruction of the alumina plate, thereby improving the quality of the noise filtering structure itself.

In order to attain the above described object, a noise suppressing connector according to the present invention comprises: a metal casing having one or more terminal insertion holes in the bottom wall thereof and formed with a capacitor section around each of the insertion holes; a pin terminal inserted through the terminal insertion hole and electrically connected to the capacitor section by way of a soldering; and an insulating housing integrally formed on the metal casing. The capacitor section further includes an insulating layer formed on the peripheral surfaces around each of the insertion hole; a terminal electrode layer formed in such a way as to cover at least one end of the insulating layer; a ground leading layer one end of which is connected to the metal casing; a dielectric layer formed between the terminal electrode layer and the ground leading layer; and an insulating coating layer covering the terminal electrode layer, the ground leading layer and the dielectric layer.

In the noise suppressing connector as constructed above, noise of the terminal is transmitted from the terminal electrode layer to the ground leading layer by way of the dielectric layer disposed therebetween, and then further to the metal casing so as to be grounded. In the present invention, since an insulating layer, a terminal electrode layer, a dielectric layer and a ground leading layer are directly mounted on the metal casing, an alumina plate which is essential in conventional noise suppressing connector is no longer required. Further, in addition to the fact that the problems such as the occurrence of the incomplete connection due to the soldering connection and rather weak structure of the alumina plate itself are eliminated, the number of parts to be used can also be reduced.

BRIEF DESCRIPTION OF THE DRAWINGS

The specific nature of the invention, as well as other objects, usage and advantages thereof will become more apparent from the following description taken in conjunction with the accompanying drawings in which.

DETAILED DESCRIPTION OF THE PREFERRED EMBODIMENTS

Figure 1:
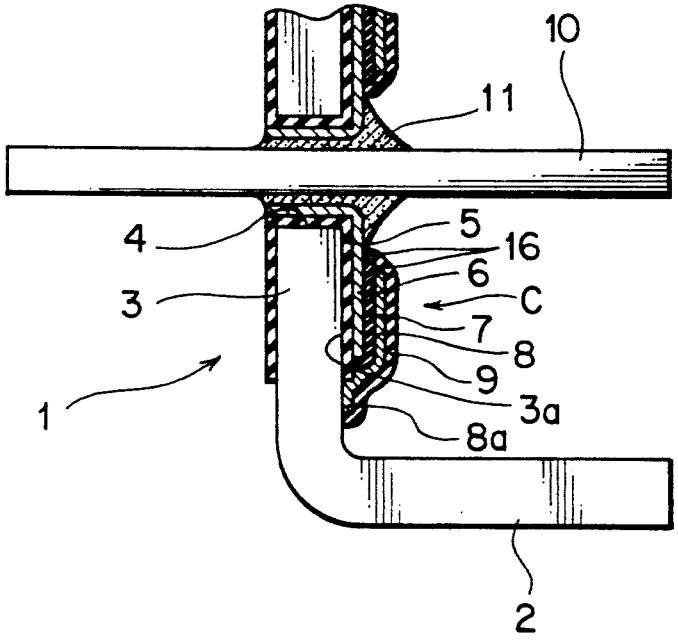
FIG. 1 is a magnified sectional view showing the important portion of the construction of the noise filtering structure according to the present invention.

In the following, the embodiments of the present invention are described with reference to the drawings. By the way, it is to be noted that like reference characters in each figure denote like or corresponding portions of the conventional embodiments so as to avoid repetition of the explanation.

Figure 2:
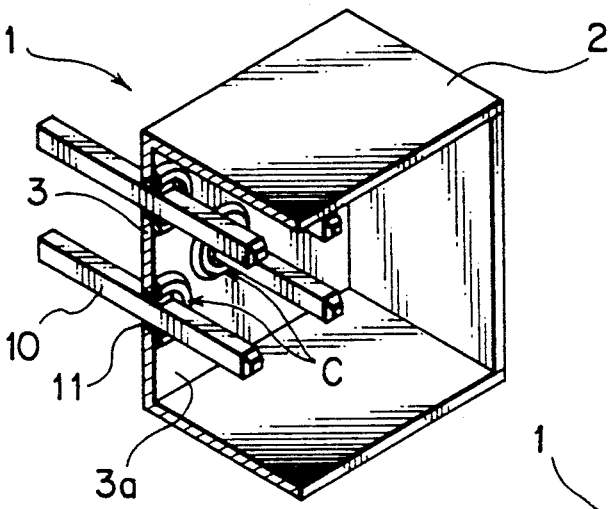
FIG. 2 is a partly broken perspective view of the same.

FIG. 1 is a sectional view showing the construction of the noise filtering structure according to the present invention, and FIG. 2 is a partly broken perspective view of the same.

The noise filtering structure 1 comprises a metal casing 2 having a terminal insertion hole 4 in the bottom wall 3 thereof, an insulating layer 5 formed on the peripheral surfaces of the terminal insertion hole 4, that is, on the respective upper and lower surfaces of the bottom wall 3 and the inner surface side of the insertion hole 4, an electric conductive terminal electrode layer 6 formed on the insulating layer 5 in such a way as to cover the two portions thereof respectively formed on the upper surface 3*a* side of the bottom wall 3 and on the inner surface side of the insertion hole 4, a dielectric layer 7 formed on the terminal electrode layer 6 in such a manner as to cover the portion thereof formed on the upper surface 3*a* side of the bottom wall 3, and an electric conductive ground leading layer 8 formed on the dielectric layer 7, the end portion 8*a* of which being connected to the bottom wall 3 of the metal casing 2, wherein the ground leading layer 8 and the exposed portions 16 respectively of the terminal electrode layer 6 and the dielectric layer 7 are all covered by an insulating coating 9 so as to form an annular capacitor C, whereby the pin terminal 10 inserted through the terminal insertion hole 4 and the terminal electrode layer 6 are electrically connected by a soldering 11.

By the way, in the above construction, a widely used hollow plate or the like formed with an insulating layer on its surface can be adopted instead of the metal casing 2. Further, each of the layers 5, 6, 7, 8 and 9 can be easily printed by an ordinary printing process. By the way, as shown in FIG. 2, the capacitor C is formed independently around each of the pin terminals 10.

Figure 3:
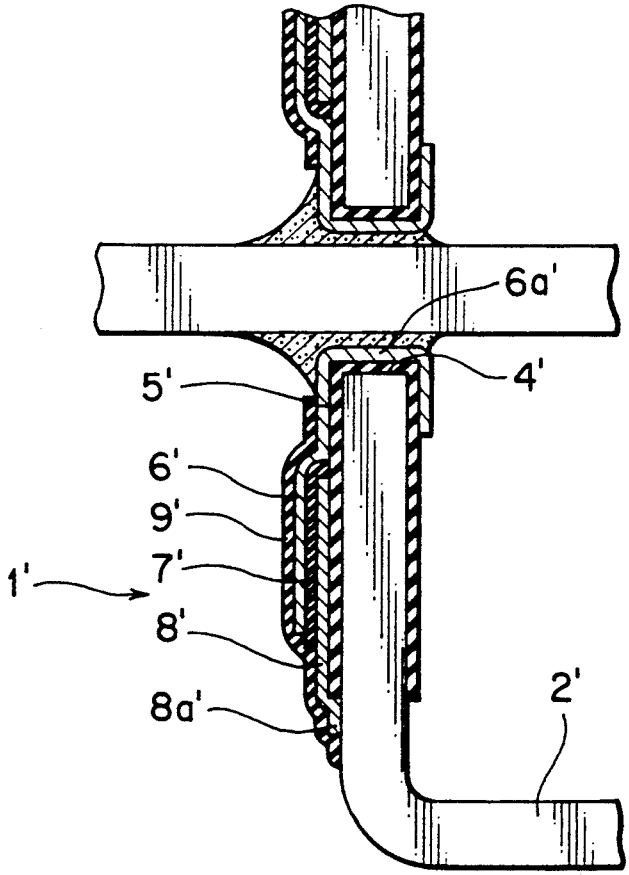
FIG. 3 is a longitudinal sectional view showing another embodiment of the noise filtering structure.

FIG. 3 is a longitudinal sectional view showing another embodiment of the noise filtering structure. In the figure, reference numeral 1' denotes the noise filtering structure which comprises a metal casing 2', an insulating layer 5' formed on the peripheral surfaces of the terminal insertion hole 4', a ground leading layer 8' having one end thereof 8*a'* electrically connected to the metal casing 2' and mounted on the insulating layer 5', a dielectric layer 7' formed on the ground leading layer 8', and a terminal electrode layer 6' whose one end is connected to the terminal insertion hole 4' side of the insulating layer 5' and another end mounted on the electrode layer 7'. By the way, reference numeral 9' denotes an insulating coating.

Figure 4:
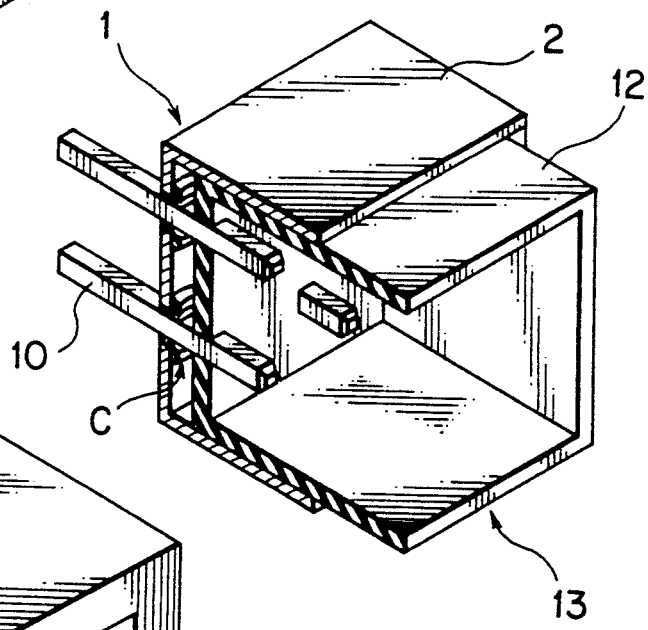
FIGS. 4 and 5 are partly broken perspective views respectively showing other embodiments of a noise suppressing connector according to the present invention.
Figure 5:
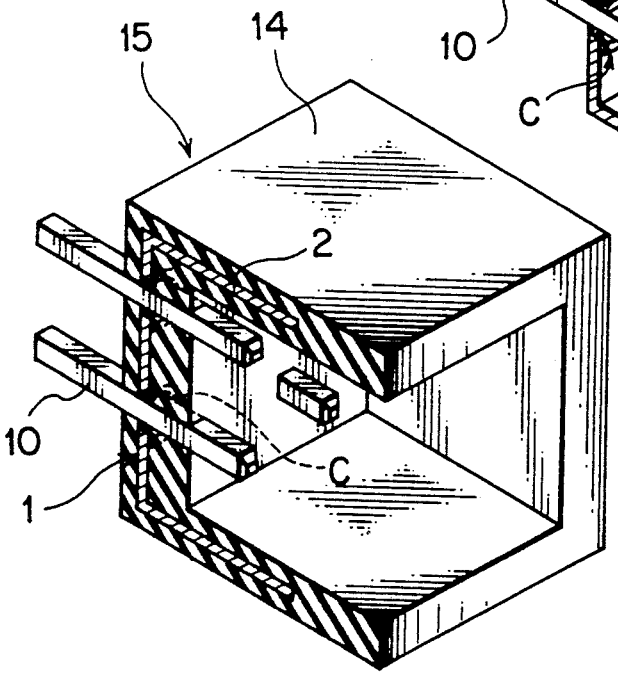
Figure 6:
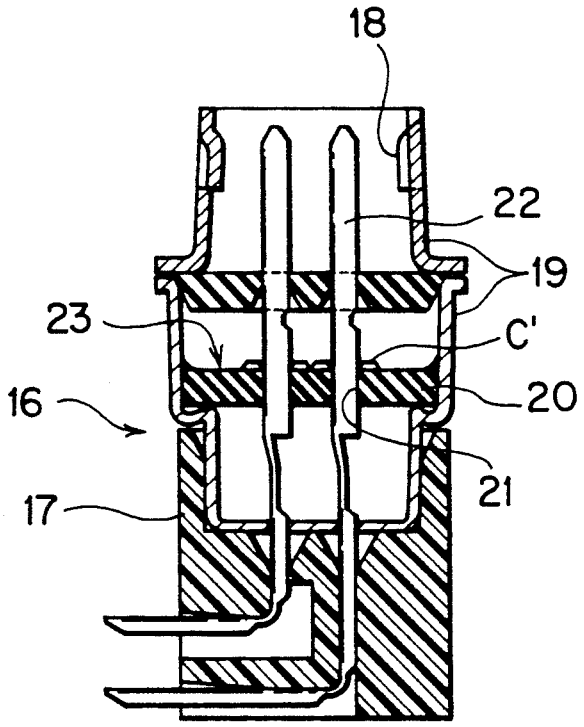
FIG. 6 is a longitudinally sectional view showing a noise suppressing connector according to the prior art.
Figure 8:
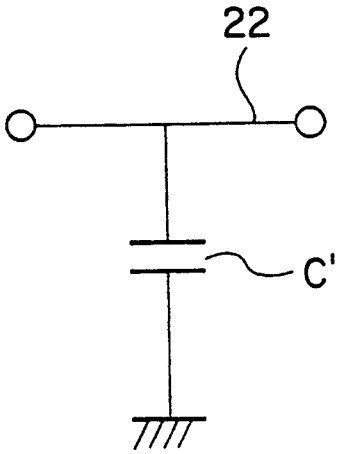
PRIOR ART FIG. 8
FIG. 8 is an illustration showing a block diagram of a circuit of the same.
Figure 7:
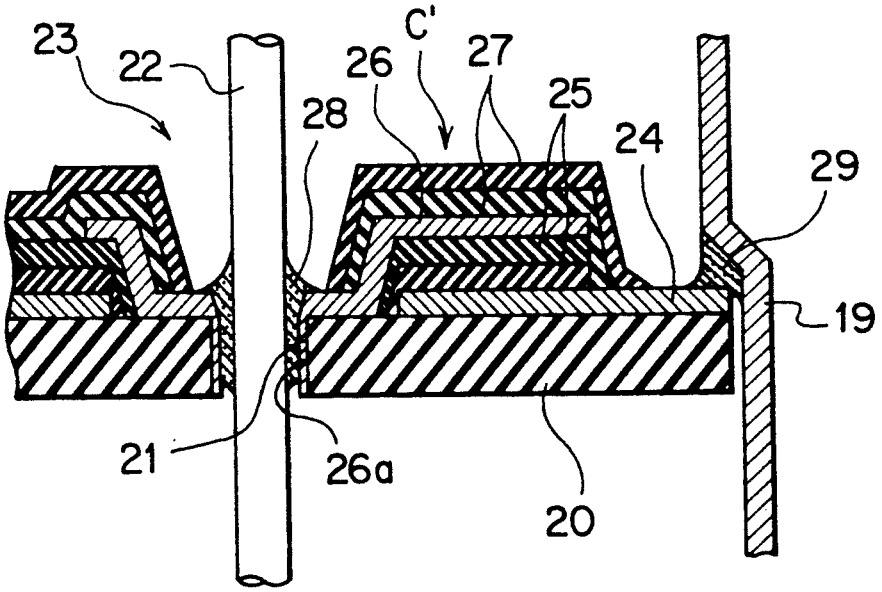
PRIOR ART FIG. 7
FIG. 7 is magnified longitudinally sectional view showing the important portion of the construction of the noise filtering structure according to the same prior art.

FIGS. 4 and 5 are partly broken perspective views respectively showing a noise suppressing connector according to the present invention, wherein FIG. 4 shows a noise suppressing connector 13 constructed in such a way that an insulating housing 12 made of synthetic resin is incorporated into the inner side of the metal casing 2 of the noise filtering structure 1. FIG. 5 shows another type of noise suppressing connector 15 constructed such that an insulating housing 14 is integrally formed to the above casing 2 by a molding process.

In summary, according to the present invention, since a capacitor composed of an insulating layer, various electrode layers and a dielectric layer is directly connected to a metal casing, a conventionally adopted alumina plate is made unnecessary. A reduction in the number of the manufacturing processes is made possible due to the reduction of mechanical parts and the abolition of the need for soldering connections. Consequently, the conductivity of the electrical connections and strength of those connections can be greatly improved.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A noise suppressing connector comprising:

a metal casing having at least one terminal insertion hole in the bottom wall thereof;

a capacitor section around each of the insertion holes, each capacitor section including an insulating layer formed on peripheral surfaces of said metal casing surrounding the respective insertion hole, a terminal electrode layer formed so as to cover at least one end of the insulating layer, a ground leading layer one end of which is connected to said metal casing, a dielectric layer formed between the terminal electrode layer and the ground leading layer, and an insulating coating layer covering the terminal electrode layer, the ground leading layer and the dielectric layer;

a pin terminal inserted through each of the terminal insertion holes and electrically connected to the respective capacitor section using soldering; and an insulating housing incorporated into said metal casing.

2. A noise suppressing connector as claimed in claim 1, wherein said metal casing is incorporated around said insulating housing.

3. A noise suppressing connector comprising:

a metal casing having at least one terminal insertion hole in the bottom wall thereof and formed with a capacitor section around each of the insertion holes;

a pin terminal inserted through each of the terminal insertion holes and electrically connected to the respective capacitor section using soldering and an insulating housing incorporated into said metal casing, each capacitor section comprising, an insulating layer formed on peripheral surfaces of said metal casing surrounding the respective insertion hole, a terminal electrode layer formed so as to cover at least one end of the insulating layer, a ground leader layer one end of which is connected to said metal casing, a dielectric layer formed between the terminal electrode layer and the ground leading layer, and an insulating coating layer covering the terminal electrode layer, the ground leading layer and the dielectric layer.

4. A noise suppressing connector as claimed in claim 3, wherein said metal casing is incorporated around said insulating housing.

* * * * *